US009464404B2

(12) United States Patent
Patte

(10) Patent No.: US 9,464,404 B2
(45) Date of Patent: Oct. 11, 2016

(54) STEPLESSLY TELESCOPABLE SLIDING BEAM DEVICE

(71) Applicant: Liebherr-Werk Ehingen GmbH, Ehingen/Donau (DE)

(72) Inventor: Alexander Patte, Allmendingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 318 days.

(21) Appl. No.: 14/165,861

(22) Filed: Jan. 28, 2014

(65) Prior Publication Data

US 2014/0216188 A1 Aug. 7, 2014

(30) Foreign Application Priority Data

Jan. 29, 2013 (DE) ..... 10 2013 001 474

(51) Int. Cl.
*B66C 23/80* (2006.01)
*E02F 9/08* (2006.01)

(52) U.S. Cl.
CPC ..... *E02F 9/085* (2013.01); *B66C 23/80* (2013.01); *Y10T 74/18992* (2015.01)

(58) Field of Classification Search
CPC ..... B60R 3/002; B60R 3/00; B60R 9/02
See application file for complete search history.

(56) References Cited

U.S. PATENT DOCUMENTS

2007/0084813 A1* 4/2007 Morath ..... B66C 23/78 212/175

FOREIGN PATENT DOCUMENTS

| | | | |
|---|---|---|---|
| DE | 10 2005 007 522 | A1 | 8/2006 |
| DE | 10 2010 056 584 | A1 | 7/2012 |
| EP | 1 772 415 | A2 | 4/2007 |

* cited by examiner

*Primary Examiner* — John Walters
*Assistant Examiner* — James Triggs
(74) *Attorney, Agent, or Firm* — Dilworth & Barrese, LLP

(57) ABSTRACT

The present invention relates to a telescopable sliding beam device with a sliding beam box and at least one first sliding beam and at least one second sliding beam, which are telescopable into each other, wherein the second sliding beam is mounted in the sliding beam box so as to be steplessly telescopable, and wherein in a first supporting region the first sliding beam is retracted and a stepless adjustment of the sliding beam device can be carried out by shifting the second sliding beam. According to the invention, the first sliding beam furthermore is extended in a second supporting region and a stepless adjustment of the sliding beam device can be carried out by shifting the second sliding beam.

20 Claims, 3 Drawing Sheets

STEPLESSLY TELESCOPABLE SLIDING BEAM DEVICE

BACKGROUND OF THE INVENTION

The present invention relates to a telescopable sliding beam device, a machine with such sliding beam device, and a method for utilizing the sliding beam device.

Telescopable sliding beam devices are known from the prior art and are employed for example in the support of machines, Machines such as e.g. cranes can be transferred from a traveling condition into a working condition. In the working condition of the crane it can be necessary to increase its stability, so as to ensure a safe crane operation. For this purpose, the sliding beams provided at the crane are extended and the props provided at the same are supported on the ground.

The base area of the crane, which correlates with the supporting base, thereby is increased. The crane thus can be stabilized and the risk of sinking, tilting or swaging of the crane can be reduced substantially as compared to a non-supported crane.

To maximize the stabilizing effect of the sliding beams, it is known to design the same as rather long portions, so as to create a rather large supporting base for the crane. Since for transport reasons the sliding beams at the same time be kept as compact as possible, it is likewise known to design the same as telescopable sliding beams of a sliding beam device.

The individual sliding beams of the sliding beam device usually include pushing blocks, via which a power transmission between the sliding beams becomes possible. It is problematic that due to the stepped arrangement of the pushing blocks only a stepped extension of the sliding beams is possible, in particular because in known sliding beam devices the drives of the individual sliding beams are coupled with each other and are jointly moved. As a result, the supporting base correspondingly also can only be designed in a stepped manner. It is possible, for example, that a fully extended sliding beam device provides for a supporting base of maximum size, but depending on the number of pushing blocks always only corresponding smaller steps or partial regions of the supporting base can be utilized for support and actually not the regions lying between these steps.

This is particularly disadvantageous when the use of the sliding beam device takes place in a spatially confined position in which a rather large supporting base is required at the same time. When for example a 90-percent supporting base is required, but due to the above-described stepped construction only either a 100-percent or a 75-percent supporting base is possible, it can become impossible to achieve the required support in the given position with an unfavorable spatial situation, i.e. when there is no room for a 100-percent support. The indicated percentages of the support or the supporting base relate to the maximum possible support, which is achievable with fully extended sliding beams. When both sliding beams are fully extended, this corresponds to a 100-percent support, and when both sliding beams are fully retracted, the support is 0%.

EP 1749789 A1 for example discloses a telescopable sliding beam device, in which two sliding beams can be telescoped. The sliding beams are shifted to each other such that in certain settings of the sliding beams previously defined load introduction points can be approached and a power transmission by the sliding beams becomes possible thereby. However, the two hydraulic cylinders which are associated to the two sliding beams are coupled with each other via a sequential pressure control, so that an independent movement of the two sliding beams is not possible. Thus, it is not possible either to make settings of the sliding beams other than those defined by the load introduction points.

SUMMARY OF THE INVENTION

Therefore, it is the object of the present invention to develop a sliding beam device as mentioned above, a machine with sliding beam device, and a method for utilizing the sliding beam device such that a stepless adjustment of the entire supporting base becomes possible.

According to the invention, this object is solved by a sliding beam device with the features described herein, according to which a telescopable sliding beam is provided, with a sliding beam box, at least one first sliding beam and at least one second sliding beam, which are telescopable into each other, wherein according to the invention the second sliding beam is mounted in the sliding beam box so as to be steplessly telescopable, wherein in a first supporting region the first sliding beam is retracted and a stepless adjustment of the sliding beam device can be carried out by shifting the second sliding beam, and wherein in a second supporting region the first sliding beam is extended and a stepless adjustment of the sliding beam device can be carried out by shifting the second sliding beam.

Such device advantageously provides for utilizing a sliding beam, which is steplessly adjustable, for the stepless adjustment of the entire sliding beam device in both supporting regions. While in one exemplary embodiment the two sliding beams thus are adjustable among each other in a stepped manner, one of the two sliding beams is steplessly adjustable relative to the sliding beam box. Since according to the invention the two sliding beams are independently actuatable, there is obtained a combination of portions adjustable in a stepped and a stepless manner, which in sum provides for a stepless adjustment of the sliding beam device over the entire supporting region, i.e. the first and the second supporting region.

In this exemplary embodiment, the first supporting region can be regarded as the smaller supporting region, in which one of the sliding beams can remain fully retracted and in which thus not the maxim um supporting region can be achieved.

The second supporting region, on the other hand, can be regarded as the larger supporting region, in which one of the sliding beams is at least partly and preferably completely extended, and in which thus the maximum supporting region can be achieved.

It is not essential for the invention whether the sliding beams are adjustable among each other in a stepped manner and one of the sliding beams is steplessly adjustable relative to the sliding beam box or vice versa. It is likewise conceivable to couple three, four or more sliding beams with each other in the manner described above. There can be realized different configurations with respect to the stepped and the stepless adjustability of the sliding beams among each other and with respect to the sliding beam box, without deviating from the inventive idea.

Preferred aspects of the invention can be taken from the description herein.

In a preferred exemplary embodiment it is provided that a supporting force can be transmitted between the second sliding beam and the sliding beam box in any position of the second sliding beam relative to the sliding beam box. It is advantageously ensured thereby that the second sliding beam is adjustable and usable for power transmission between prop and sliding beam box in any extended condition, i.e. in a stepless manner.

In a further preferred exemplary embodiment it is conceivable that the sliding beams are movable by extension cylinders, which can actively be actuated independent of each other, Such independent actuation in particular provides for either fully retracting or fully extending one of the sliding beams, while the other sliding beam can independently be moved or also be kept at rest. As a next step, or during this step, the other sliding beam then can independently be adjusted in a stepless manner. It is likewise not essential for the invention whether first the sliding beam adjustable in a stepped manner and then the steplessly adjustable sliding beam is shifted or vice versa. It merely is essential for the invention that the two sliding beams are adjustable independent of each other. The timing also plays no role essential for the invention, as it is conceivable to shift the two sliding beams wholly or partly at the same time, but independent of each other.

In a preferred exemplary embodiment it is possible that the first sliding beam is extended completely in the second supporting region. This example represents a particularly simple embodiment of the device, as here the solution of the object is achieved with the smallest possible number of adjustment stages between the sliding beams. It is also possible to provide the first sliding beam only partly extended, in order to then provide for a stepless adjustment within the second supporting region by means of the steplessly adjustable second sliding beam. It is merely required that the sliding beams are adjustable to each other in further positions than only the completely retracted and the completely extended position.

For positioning the sliding beams relative to each other it is provided in a further preferred exemplary embodiment that a force can be transmitted between first sliding beam and second sliding beam via at least two pushing blocks. In general, the number of the pushing blocks is freely selectable, and it must merely be ensured that the same are adapted to transmit forces from one sliding beam into the other. In a particularly simple embodiment there are provided just so many pushing blocks that forces can be transmitted between the sliding beams in the two positions in which the first sliding beam is completely retracted and completely extended.

The invention furthermore relates to a machine, preferably a truck crane or an excavator, with at least one telescopable sliding beam device according to the description herein.

Furthermore, the invention relates to a method for supporting a machine, preferably a truck crane or an excavator, with at least one telescopable sliding beam device according to the description herein wherein the first sliding beam is fixed relative to the second sliding beam, and wherein the second sliding beam is steplessly telescoped relative to the sliding beam box.

In turn, it is possible to arrange the sliding beams in the reverse way, i.e. to design the second sliding beam adjustable in a stepped manner relative to the sliding beam box and to provide the first sliding beam steplessly adjustable relative to the second sliding beam.

In a particular exemplary embodiment it is possible that the first sliding beam is retracted completely relative to the second sliding beam. This is advantageous in particular when utilizing the method in the first supporting region, as the first sliding beam thus need not be shifted at all and a stepless adjustment of the sliding beam device only can be effected by means of the steplessly adjustable second sliding beam.

In another preferred exemplary embodiment it is possible that the first sliding beam is extended completely relative to the second sliding beam. This is advantageous in particular when utilizing the sliding beam device in the second working region, as thus the complete spectrum of the second working region can be approached steplessly by means of the steplessly adjustable first sliding beam.

BRIEF DESCRIPTION OF THE DRAWINGS

Further details and advantages of the invention will be explained in detail below with reference to an exemplary embodiment illustrated in the Figures, in which.

DESCRIPTION OF THE PREFERRED EMBODIMENTS

Figure 1:
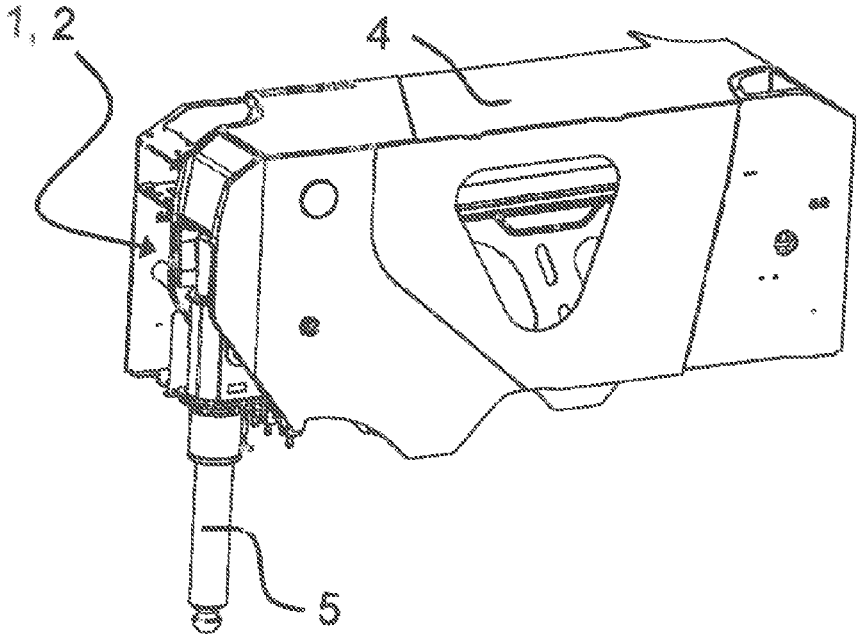
FIG. 1: shows a schematic representation of the sliding beam device with supporting base 0%.

FIG. 1 shows a sliding beam device with minimum supporting base, i.e. both sliding beams 1, 2 are retracted into each other and into the sliding beam box 4. The support cylinder 5 extends below the sliding beams 1, 2 and the sliding beam box 4.

Figure 2:
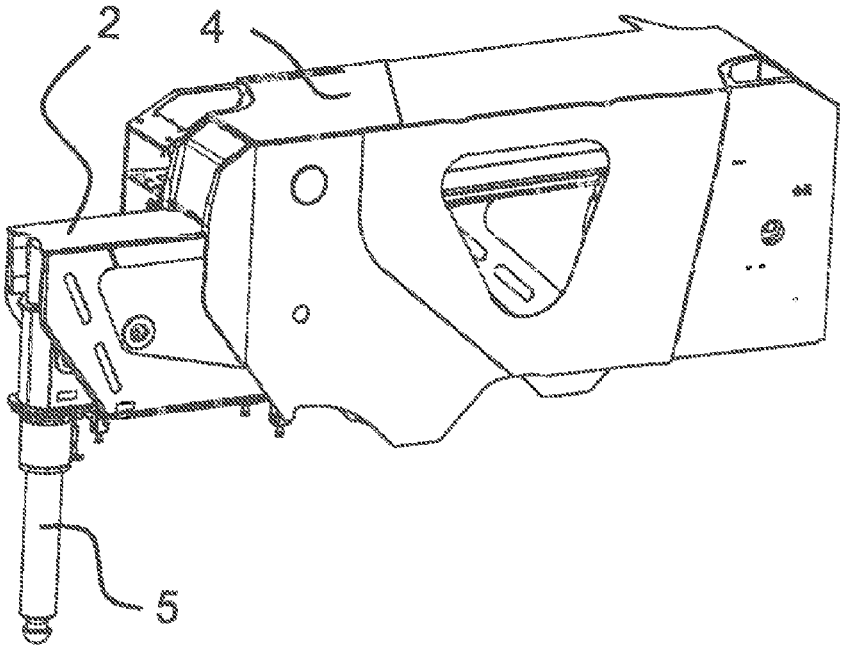
FIG. 2: shows a schematic representation of sliding beam device with supporting base 25%.
Figure 6:
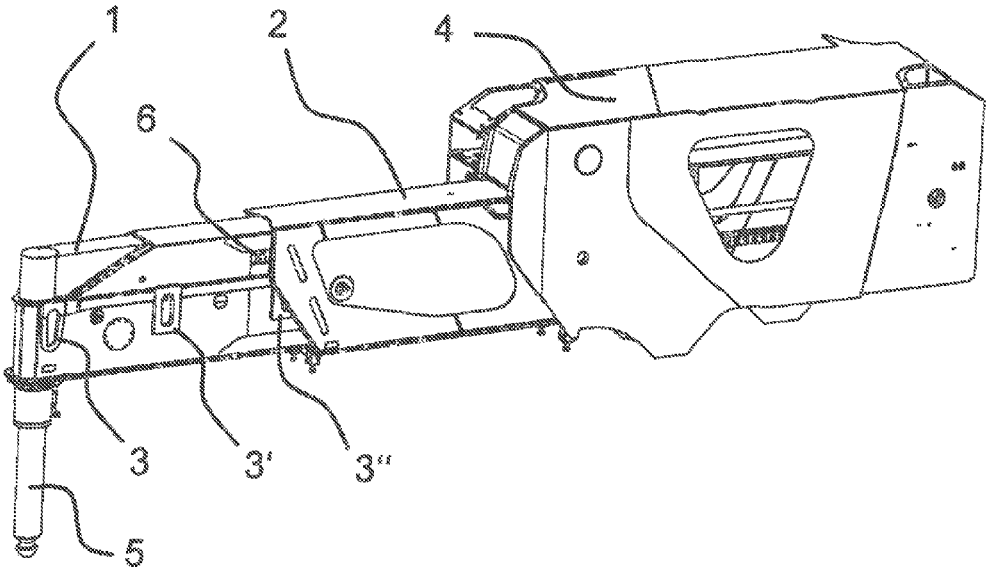
FIG. 6: shows a schematic representation of the sliding beam device with supporting base 100%.

To increase the supporting base, the sliding beam device now can be extended, as shown in FIG. 2, In the exemplary embodiment shown, the maximum supporting base would be achieved, when both sliding beams 1, 2 are maximally extended (see FIG. 6). The half, i.e. 50-percent, supporting base would be achieved when either one of the two sliding beams 1, 2 is fully extended and the other one is completely retracted, or when both sliding beams 1, 2 each are half extended (see FIGS. 3 and 4). Since the latter does not provide a new supporting base, it might also be saved, whereby the pushing block 3' also might be omitted.

In FIG. 2, a 25-percent supporting base is achieved, wherein the sliding beam 1 remains retracted completely and the sliding beam 2 is extended for 50%.

Figure 3:
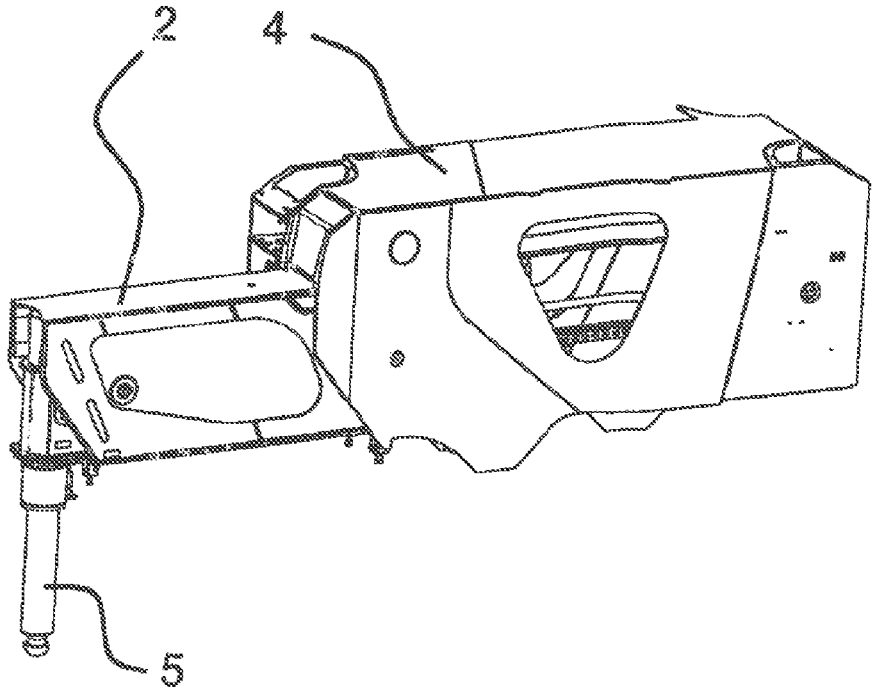
FIG. 3: shows a schematic representation of the sliding beam device with supporting base 50%, first possibility.

In FIG. 3, a 56-percent supporting base is achieved, in that sliding beam 1 remains retracted completely and sliding beam 2 is extended for 100%. Since sliding beam 2 is steplessly adjustable relative to the sliding beam box 4, the region of the supporting base thus can steplessly be adjusted from 0% to 50% by steplessly telescoping the sliding beam 2, while the sliding beam is retracted at the same time. This region represents the first supporting region of the device.

Figure 4:
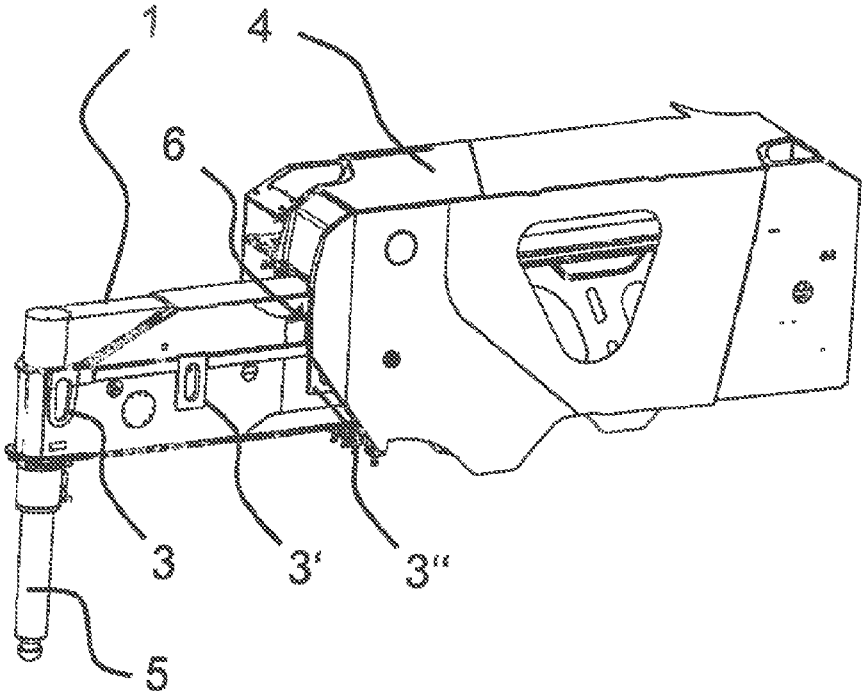
FIG. 4: shows a schematic representation of the sliding beam device with supporting base 50%, second possibility.

A supporting base of 50% also can be achieved alternatively by completely extending the sliding beam 1 and completely retracting the sliding beam 2, as shown in FIG. 4.

Figure 5:
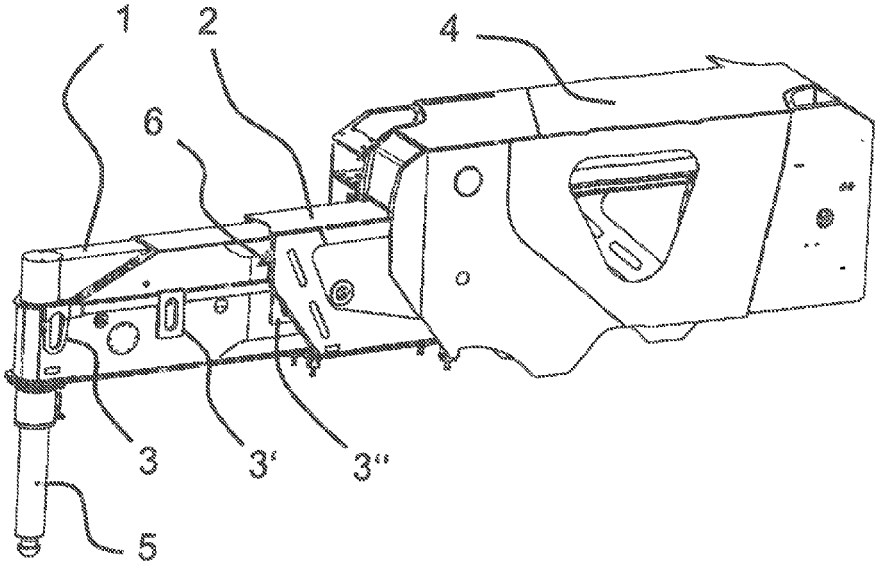
FIG. 5: shows a schematic representation of the sliding beam device with supporting base 75%.

When the sliding beam device is to be adjusted steplessly in the second supporting region, the sliding beam 1, as shown in FIG. 5, is extended for 100% and the sliding beam 2 is steplessly telescoped into the desired region. In the illustrated exemplary embodiment of FIG. 5, sliding beam 2 is extended for 50% and sliding beam 1 for 100%, so that a total supporting base of 75% is obtained.

The exemplary embodiment shown in FIG. 6 shows the maximum supporting base, i.e. a 100-percent supporting base, wherein both sliding beam 1 and sliding beam 2 each are extended for 100%. What is visible or indicated here are pushing blocks 3, 3', 3" and 6, via which a power transmission between the sliding beams 1, 2 can occur. In the exemplary embodiment shown, sliding beam 1 is extended completely, so that a power transmission between sliding beam 1 and sliding beam 2 can be effected via the pushing block 3" at the sliding beam 1 and the indicated pushing block 6 at the sliding beam 2.

The invention claimed is:

1. A telescopable sliding beam device with a sliding beam box (4), at least one first sliding beam (1) and at least one second sliding beam (2), which are telescopable into each other, wherein the second sliding beam (2) is mounted in the sliding beam box (4) to be steplessly and partially telescopable between completely extended and retracted positions, the first sliding beam (1) is mounted in the sliding beam box (4) to only be fully extendable or retractable between fully extended and retracted positions, with the first (1) and second (2) sliding beams mounted to be independently actuatable from one another such that in a first supporting region, the first sliding beam (1) is fully retracted and a stepless adjustment of the sliding beam device is carried out by steplessly shifting the second sliding beam (2), and in a second supporting region, the first sliding beam (1) is fully extended and a stepless adjustment of the sliding beam device is carried out by steplessly shifting the second sliding beam (2).

2. The telescopable sliding beam device according to claim 1, wherein a supporting force, in particular in crane operation, is transmitted between the second sliding beam (2) and the sliding beam box (4) in any position of the second sliding beam (2) relative to the sliding beam box (4).

3. The telescopable sliding beam device according to claim 1, wherein the sliding beams (1, 2) are movable by extension cylinders which are actively actuated independently of each other.

4. The telescopable sliding beam device according to claim 1, wherein the first sliding beam (1) is completely extended in the second supporting region.

5. The telescopable sliding beam device according to claim 1, wherein a force is transmitted from the first sliding beam (1) into the second sliding beam (2) via at least two pushing blocks (3, 3', 3", 6).

6. A machine, preferably a truck crane or excavator, with at least, one telescopable sliding beam device according to claim 1.

7. A method for supporting a machine, preferably a truck crane or an excavator, with at least one telescopable sliding beam device according to claim 1 wherein the first sliding beam (1) is fixed relative to the second sliding beam (2), and the second sliding beam (2) steplessly telescoped relative to the sliding beam box (4).

8. The method according to claim 7, wherein the first sliding beam (1) is fixed relative to the second sliding beam (2) in the completely retracted condition.

9. The method according to claim 7, wherein the first sliding beam (1) is fixed relative to the second sliding beam (2) in the completely extended condition.

10. The telescopable sliding beam device according to claim 2, wherein the sliding beams (1, 2) are movable by extension cylinders which are actively be actuated independently of each other.

11. The telescopable sliding beam device according to claim 10, wherein the first sliding beam (1) is completely extended in the second supporting region.

12. The telescopable sliding beam device according to claim 3, wherein the first sliding beam (1) is completely extended in the second supporting region.

13. The telescopable sliding beam device according to claim 2, wherein the first sliding beam (1) is completely extended in the second supporting region.

14. The telescopable sliding beam device according to claim 13, wherein a force is transmitted from the first sliding beam (1) into the second sliding beam (2) via at least two pushing blocks (3, 3', 3", 6).

15. The telescopable sliding beam device according to claim 12, wherein a force is transmitted from the first sliding beam (1) into the second sliding beam (2) via at least two pushing blocks (3, 3', 3", 6).

16. The telescopable sliding beam device according to claim 11, wherein a force is transmitted from the first sliding beam (1) into the second sliding beam (2) via at least two pushing blocks (3, 3' 3", 6).

17. The telescopable sliding beam device according to claim 10, wherein a force is transmitted from the first sliding beam (1) into the second sliding beam (2) via at, least two pushing blocks (3, 3', 3", 6).

18. The telescopable sliding beam device according to claim 4, wherein a force is transmitted from the first sliding beam (1) into the second sliding beam (2) via at least two pushing blocks (3, 3', 3", 6).

19. The telescopable sliding beam device according to claim 3, wherein a force is transmitted from the first sliding beam (1) into the second sliding beam (2) via at least two pushing blocks (3, 3', 3", 6).

20. The telescopabie sliding beam device according to claim 1, wherein the second sliding beam (2) is the outer beam and the first sliding beam (1) is the inner beam.

* * * * *